United States Patent [19]

Franks

[11] Patent Number: 4,919,021

[45] Date of Patent: Apr. 24, 1990

[54] PLIERS FOR CLOSING A LOCKING RING

[75] Inventor: Joseph K. Franks, Rosman, N.C.

[73] Assignee: Jensen Engineering, Asheville, N.C.

[21] Appl. No.: 929,009

[22] Filed: Nov. 10, 1986

[51] Int. Cl.[5] ..... B25B 7/02

[52] U.S. Cl. ..... 81/426.5; 81/417; 81/418; 29/243.56

[58] Field of Search ..... 81/426.5, 415, 416, 81/417, 418, 385, 393, 395, 398, 341, 318, 300; 29/243.56

[56] References Cited

U.S. PATENT DOCUMENTS

| | | | |
|---|---|---|---|
| 908,947 | 1/1909 | Burkhart | 81/417 |
| 2,375,512 | 5/1945 | Baade | 81/341 |
| 3,161,086 | 12/1964 | Kircher | 81/426.5 |
| 3,170,237 | 2/1965 | Weidauer | 81/417 |
| 4,476,616 | 10/1984 | Jensen | 29/243.56 |
| 4,563,833 | 1/1986 | Aucoin | 81/417 X |
| 4,757,730 | 7/1988 | Porat et al. | 81/426.5 |

FOREIGN PATENT DOCUMENTS

| | | | |
|---|---|---|---|
| 2119695 | 11/1983 | United Kingdom | 81/417 |

*Primary Examiner*—James G. Smith
*Attorney, Agent, or Firm*—David M. Carter

[57] ABSTRACT

There is provided specialized pliers particularly adapted to close a locking ring which has locking members on the different planes. The pliers include a pair of jaws, each having grooves for receiving the locking ring. Inclined planes, which abut against one another as the jaws close, are provided on both jaws for moving the jaws normal to their plane of rotation thus bending the locking ring so that the locking mechanism will be interconnected. Spring elements are provided for maintaining the jaws in a predetermined position relative to one another.

10 Claims, 2 Drawing Sheets

PLIERS FOR CLOSING A LOCKING RING

BACKGROUND OF THE INVENTION

This invention relates to pliers. More particularly it relates to specialized pliers for closing a locking ring.

A unique locking ring has been developed by George W. Jensen and it, together with a pneumatic clenching tool, are described and claimed in U.S. Pat. No. 4,476,616 the disclosure of which is hereby incorporated herein by reference. The Jensen locking ring was developed primarily as an improvement over the Hog ring. The Jensen locking ring utilizes a pair of locking loops which are on different planes from one another. It is particularly useful in applications requiring great strength such as, for example, holding gabions together where the locking ring must withstand hundreds of pounds of force. As shown in U.S. Pat. No. 4,476,616, a pneumatic tool was developed to interconnect the loops thus clenching the locking ring. The pneumatic tool utilizes a die having a pair of oppositely-tapered grooves for providing the clenching operation. Furthermore, a magazine containing a plurality of locking rings is normally utilized with the pneumatic tool making that system high-speed.

However, there is a need for an inexpensive and easy to use apparatus for clenching the Jensen locking ring where the speed of operation is not a great limiting factor.

Various pliers and other tools have been developed for closing staples and rings such as hog rings. Examples of such tools are described in U.S. Pat. Nos. 2,562,097 issued to Heuer, 2,299,858 issued to Sorenson, 1,848,763 issued to Baringer, and 3,507,305 issued to Crabb; however, the devices shown in those patents are not suitable to clench the Jensen locking ring.

OBJECTS OF THE INVENTION

Therefore, it is one object of this invention to provide improved pliers for clenching a locking ring.

It is still another object to provide pliers for clenching a locking ring which are inexpensive and easy to use.

It is still another object to provide a mechanism for clenching a locking ring which is uncomplicated and reliable.

SUMMARY OF THE INVENTION

In accordance with one form of this invention, there is provided pliers having first and second handles, each of which has a jaw element. A mechanism is provided for pivoting the handles in a plane of rotation relative to one another. A mechanism is further provided for moving the jaw elements in a direction normal to the plane of rotation.

In the preferred embodiment of the invention, the mechanism for moving the jaw elements in the direction normal to the plane of rotation includes a pair of inclined planes on each handle which come in contact with one another as the free ends of the jaw elements are moved towards one another.

A spring mechanism may be provided for urging the handles together and a further spring mechanism may be provided for maintaining the jaw elements in a predetermined position for proper spacing when initially receiving and holding an unclenched locking ring.

DESCRIPTION OF THE PREFERRED EMBODIMENT

Figure 1:
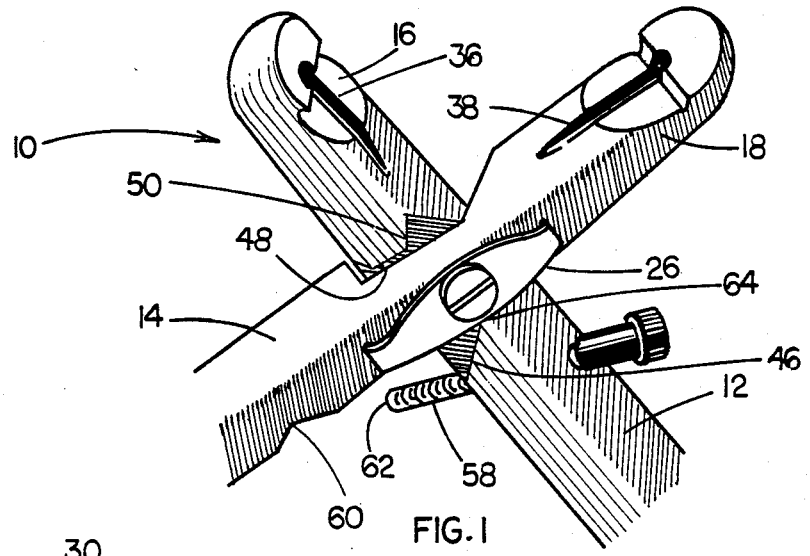
FIG. 1 is a partial front perspective view of the pliers of the subject invention.

Referring now more particularly to FIG. 1, there is provided pliers 10 having first handle 12 and second handle 14. Handle 12 includes jaw element 16 and handle 14 includes jaw element 18. Jaw elements 16 and 18 include free ends which are moved toward and away from one another. The handles pivot about a rod 20 which is better seen in reference to FIG. 2. Rod 20 is received in a bore hole which penetrates completely through handles 12 and 14. Rod 20 includes head 22. Portions of rod 20 are threaded so as to receive threaded nut 24. Leaf spring 26 is attached to rod 20 for urging jaws 16 and 18 toward one another in a direction normal to the plane of rotation of handles 12 and 14. Coil spring 28 is wrapped around rod 20 and is retained on the rod by means of washer 30. The ends of coil spring 28 are attached to handles 16 and 18 at holes 32 and 34. Coil spring 28 urges the free ends of the jaw elements towards one another in the plane of rotation of handles 12 and 14. The importance of this feature will be explained below.

Figure 5:
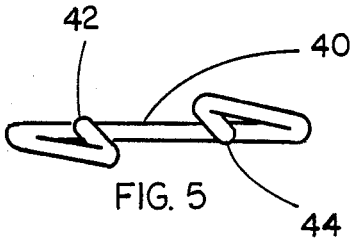
FIG. 5 is a side elevational view of the Jensen ring which may be clenched by the pliers of FIG. 1.

Referring again to FIG. 1, jaws 16 and 18 include grooves 36 and 38 which are adapted to receive a ring and preferably the Jensen locking ring, an example of which is shown in FIG. 5 as item 40.

As can be seen from FIG. 5, the locking ring 40 includes locking loops 42 and 44 which are not on the same plane with one another. Therefore, in order to clench or close the ring, the locking loops must be forced to interconnect with one another.

Figure 2:
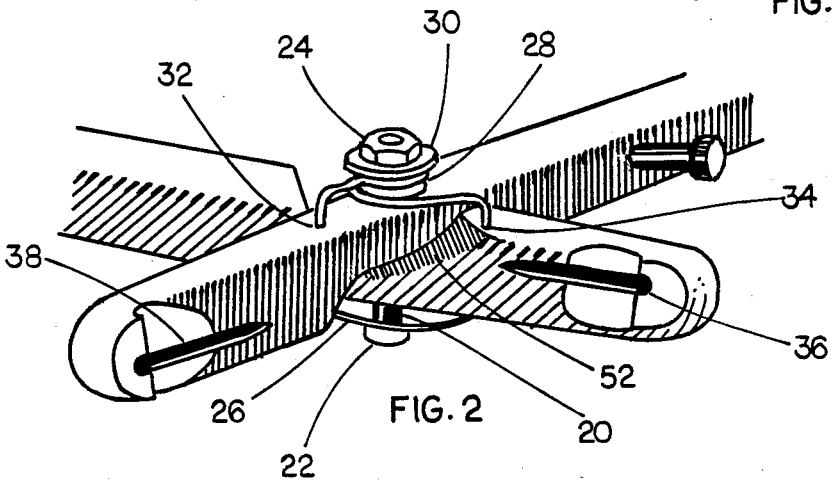
FIG. 2 is a partial top perspective view showing the pliers of FIG. 1 with the jaws a first position relative to one another.
Figure 8:
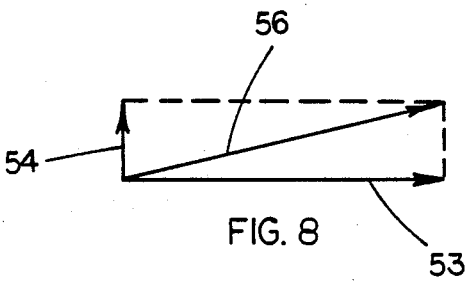
FIG. 8 is a simplified vector analysis diagram of the motion of each of the jaw elements of the pliers relative to their plane of rotation.
Figure 9:
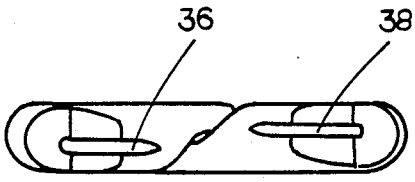
FIG. 9 is a partial top view of the pliers of FIG. 4 position.

Referring again to FIG. 1, handle 12 includes elongated groove 46 while handle 14 includes elongated groove 48. Groove 48 may be better seen in reference to FIG. 6. Inclined planes 50 and 52 respectively form the sloped upper walls of grooves 46 and 48 respectively. As the free ends of the jaw elements are moved toward one another by the movement of handles 12 and 14, inclined planes 50 and 52 contact one another causing the jaw elements 16 and 18 to move in a direction normal to the plane of rotation of the handles. Thus the grooves 36 and 38, which are preferably in slightly different planes prior to the movement of the free ends of the jaw elements toward one another also move in a direction normal to the rotation plane causing the locking loops 42 and 44 to move towards one another and align with one another in a common plane at the time of clenching. FIG. 2 shows the grooves 36 and 38 out of line prior to the movement of the free ends of the jaw elements toward one another and FIG. 9 shows that the grooves are in slightly different planes after the free ends of the jaw elements have been moved towards one another. Preferably during closure the grooves pass through the same plane at some position. A vector analysis of this movement of jaws and grooves is shown graphically in FIG. 8.

Horizontal line 53 represents the rotating plane of the jaws relative to one another, while line 54 represents vertical motion normal to plane 53. The resultant vector of the horizontal and vertical movement is indicated by line 56. The inclined planes 50 and 52 rise from the bottom of elongated grooves 46 and 48 at an angle with respect to center line of the handles and the plane of rotation of the jaws. Preferably the angle with respect to the plane of rotation is 45° and the angle with respect to the center line of the handle is preferably 25°.

Figure 3:
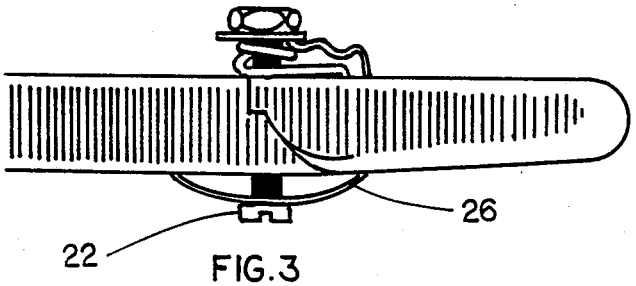
FIG. 3 is a partial side elevational view showing a portion of the pliers of FIG. 2.

Referring now to FIG. 3, the jaw elements are resting against one another at the bottom of grooves 46 and 48 because of the action of leaf spring 26 pressing against screw head 22. This maintains the grooves 36 and 38 slightly out of alignment to make it easier to insert a locking ring between the jaws.

Figure 4:
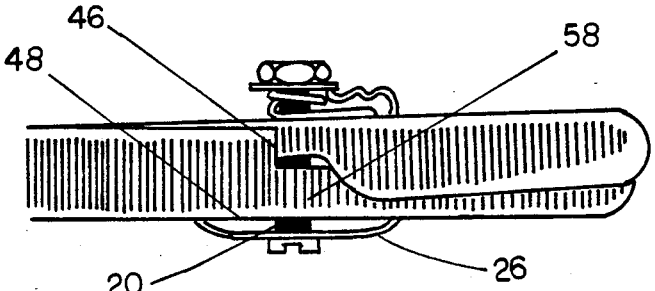
FIG. 4 is a partial side elevational view of the pliers of FIG. 3 showing the jaws in a second position relative to one another.

Referring now to FIG. 4, with the free ends of the jaw elements 16 and 18 having been moved toward one another, that is, with the inclined planes 50 and 52 in contact with one another and running up on one another, the jaw elements separate from one another in particularly at grooves 46 and 48, exposing middle portion 58 of rod 20. As can be seen in FIG. 4, spring member 26 is in its compressed state and less of the end of the rod 20 near screw head 24 is exposed than in FIG. 3.

Figure 7:
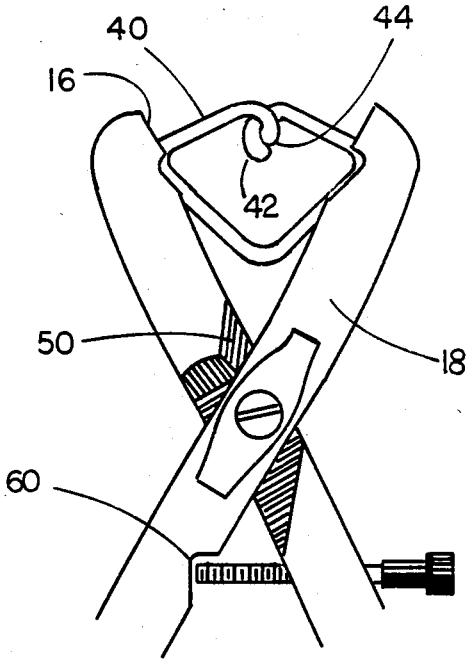
FIG. 7 is a partial front elevational view of the pliers of FIG. 4 showing the Jensen ring in the closed or clenched position.

Referring now more particularly to FIG. 7, the Jensen ring 40 has been clenched by the joining of locking loops 42 and 44 and as can be seen, a portion of jaw element 18 has ridden up on inclined plane 50 of jaw element 16 resulting in the configuration shown in FIG. 4.

Referring back now to FIG. 1, threaded rod 58 is received through a threaded bore hole (not shown) in handle 12. Handle 14 includes groove 60. As can be better seen in FIG. 7, end 62 of rod 58 is received in groove 60 thereby providing a stop so that one cannot close the Jensen ring 40 too far. The threaded on rod 58 enables the jaws to be adjustable as to the degree of closure. In order to prevent the opening of the jaws too far, shoulders 64 and 66 are provided on handles 12 and 14 respectively forming the bottom vertical wall of grooves 46 and 48. The opposite handle will abut against the shoulders if one were to try to open the jaws too far.

Figure 6:
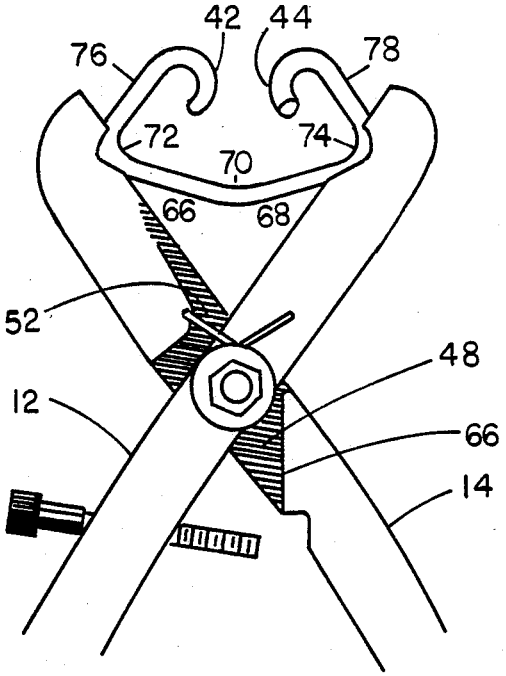
FIG. 6 is a partial rear elevational view of the pliers of FIG. 2 showing the Jensen ring contained therein.

As described above, the preferable locking ring to be used with the above-described pliers is the Jensen locking ring referred to in U.S. Pat. No. 4,476,616 the disclosure of which is hereby incorporated herein by reference. The Jensen locking ring is an open ring of material of a type which imparts spring resilience to the ring and may be made out of material such as steel. As shown in FIG. 6, the ring has a center section of two substantially straight links 66 and 68. The center section includes a bend 70 between the links forming an angle of greater than 90°, but less than 180°. Second and third bends 72 and 74 are also provided and have angles of less than 90°. Arms 76 and 78 extend from the second and third bends and then from the links. The sum of the three angles is greater than 180° but less than 360°. Each arm 76 and 78 is on a different plane from the center section. The locking loops 42 and 44 form continuous arcs of at least 120° but less than 360°.

The above-described pliers is specifically adapted to clench the above-described Jensen locking ring in an efficient and economical manner. The pliers are durable and easy to use and require almost no maintenance.

From the foregoing description of the preferred embodiment of the invention, it will be apparent that many modifications may be made therein. It is intended that the appended claims cover all such modifications as falls within the true spirit and scope of the invention.

I claim:

1. Pliers comprising;

first and second handles; said handles each having a jaw element; each jaw element having a free end; means for pivoting said handles in a plane of rotation for moving said free ends; means for urging said jaw elements away from one another in a direction normal to said plane of rotation of said handles; said means for urging including an incline plane on each of said jaw elements; a groove in each jaw; said grooves substantially facing one another; said incline planes contacting one another as said free ends of said jaw elements are moved toward one another thereby moving said grooves in a direction normal to the plane of rotation of said handles.

2. Pliers as set forth in claim 1, further including first spring means for urging said jaw elements toward one another in the direction normal to said plane of rotation.

3. Pliers as set forth in claim 2 further including second spring means for urging said free ends of said jaw elements towards one another.

4. Pliers as set forth in claim 3, wherein said first and second spring means are attached to said means for pivoting.

5. Pliers as set forth in claim 4 further including first stop means for preventing said free ends of said jaw elements from contacting one another.

6. Pliers as set forth in claim 5 further including second stop means.

7. Pliers as set forth in claim 5, wherein said first stop means includes a rod extending through said first handle, and a groove in said second handle for contacting one end of said rod, said rod being adjustable.

8. Pliers as set forth in claim 6, wherein said second stop means includes at least one shoulder on one of said handles.

9. Pliers as set forth in claim 8, further including shoulders on each handle which abut against each other.

10. Pliers comprising:

first and second handles; said handles each having a jaw element; means connected to said handles for pivoting said jaw elements relative to one another in a plane of rotation; each of said jaw elements having a free end; an incline plane on each jaw; said incline planes contacting one another as said free ends of said jaw elements move toward one another forcing said jaw elements to move normal to said plane of rotation; a first spring attached to said means for pivoting for urging said jaw elements toward one another normal to said plane of notation; a second spring connected to said means for pivoting for urging said free ends of said jaw elements toward one another; a groove in each jaw; said grooves substantially facing one another; said grooves being substantially offset from each other prior to said free ends of said jaw elements being moved towards one another; said grooves being moved in a direction normal to said plane of rotation when said incline planes are brought into contact with one another by the movement of said free ends of said jaw elements toward one another.

* * * * *